US008366254B2

(12) United States Patent
Platt et al.

(10) Patent No.: US 8,366,254 B2
(45) Date of Patent: Feb. 5, 2013

(54) METHOD AND APPARATUS FOR MELT CESSATION TO LIMIT INK FLOW AND INK STICK DEFORMATION

(75) Inventors: David P. Platt, Newberg, OR (US); Chad D. Freitag, Portland, OR (US); Isaac S. Frazier, Portland, OR (US); Jason Woebkenberg, Lake Oswego, OR (US); Brent R. Jones, Sherwood, OR (US)

(73) Assignee: Xerox Corporation, Norwalk, CT (US)

( * ) Notice: Subject to any disclaimer, the term of this patent is extended or adjusted under 35 U.S.C. 154(b) by 506 days.

(21) Appl. No.: 12/411,695

(22) Filed: Mar. 26, 2009

(65) Prior Publication Data

US 2010/0245506 A1 Sep. 30, 2010

(51) Int. Cl.
*B41J 2/175* (2006.01)

(52) U.S. Cl. ..... 347/88

(58) Field of Classification Search ..... 347/5, 17, 347/18, 88, 99
See application file for complete search history.

(56) References Cited

U.S. PATENT DOCUMENTS

| | | | | |
|---|---|---|---|---|
| 5,386,224 | A * | 1/1995 | Deur et al. | 347/7 |
| 5,621,444 | A * | 4/1997 | Beeson | 347/88 |
| 6,210,629 | B1 | 4/2001 | Bruckner et al. | |
| 6,713,728 | B1 * | 3/2004 | Justice et al. | 219/469 |
| 6,817,191 | B2 * | 11/2004 | Watanabe | 62/3.7 |
| 6,981,754 | B2 | 1/2006 | Godil et al. | |
| 7,147,313 | B2 | 12/2006 | Godil et al. | |
| 7,182,448 | B2 * | 2/2007 | Godil et al. | 347/88 |
| 7,210,774 | B2 * | 5/2007 | Jones | 347/88 |
| 7,458,669 | B2 | 12/2008 | Jones et al. | |
| 8,022,335 | B2 * | 9/2011 | Burton et al. | 219/216 |

* cited by examiner

*Primary Examiner* — Anh T. N. Vo
(74) *Attorney, Agent, or Firm* — Maginot, Moore & Beck, LLP

(57) ABSTRACT

A system has been developed that controls application of heat with a melt plate to an ink stick in a solid ink imaging device. The system includes a melt plate, a heater configured to heat the melt plate to a temperature sufficient to melt solid ink, a heat transfer unit configured to cool the melt plate to arrest the melting of the solid ink within a predetermined time, and a controller configured to actuate the heat transfer unit to selectively cool the melt plate in response to reaching a heater power off phase.

9 Claims, 7 Drawing Sheets

METHOD AND APPARATUS FOR MELT CESSATION TO LIMIT INK FLOW AND INK STICK DEFORMATION

TECHNICAL FIELD

The devices and methods disclosed below generally relate to solid ink imaging devices, and, more particularly, to solid ink handling systems for imaging devices that deliver solid ink sticks along an ink stick channel to a melting device in a solid ink printer.

BACKGROUND

Solid ink or phase change ink printers conventionally receive ink in a solid form, either as pellets or as ink sticks. The solid ink pellets or ink sticks are typically inserted through an insertion opening of an ink loader for the printer, and the ink sticks are pushed or slid along the feed channel by a feed mechanism and/or gravity toward a melt plate in the heater assembly. The melt plate melts the solid ink impinging on the plate into a liquid that is delivered to an ink reservoir which maintains the ink in melted form for delivery to a print head for jetting onto a recording medium.

During operation of solid ink printers, the heat in the thermal mass of the melt plate following termination of power to the melt plate may be sufficient to melt an appreciable amount of additional ink. If the reservoir supplied by the melt plate was full or nearly full when the power was terminated, the additional melted ink may cause the reservoir to overfill. Additionally, the heat in the melt plate dissipated after power termination may cause the leading ink stick to deform. The portion of the ink stick against the melt plate may not receive enough heat to continue molten flow, but may deform by spreading, for example, near the melt front. This deformation may subsequently result in melt flow at the sides or in the ink stick being directed through the feed channel in an off-axis direction that may impact the efficiency of ink stick melting once power is re-coupled to the melt plate. Therefore, interaction of an ink stick and a melt plate as the melt plate cools may impact operation of a solid ink stick printer.

SUMMARY

A system has been developed that controls application of heat with a melt plate to an ink stick in a solid ink imaging device. The system includes a melt plate, a heater configured to heat the melt plate to a temperature sufficient to melt solid ink, a heat transfer unit configured to cool the melt plate to arrest the melting of the solid ink within a predetermined time, and a controller configured to actuate the heat transfer unit to selectively cool the melt plate in response to reaching a heater power off phase.

A method has also been developed that controls application of heat with a melt plate to an ink stick in a solid ink imaging device. The method includes monitoring state of electrical power provided to a heater that heats a melt plate positioned at one end of a feed channel in a solid ink printer, and cooling the melt plate to arrest melting of the leading edge of the ink stick within a predetermined time relative to reaching a heater power off phase.

BRIEF DESCRIPTION OF THE DRAWINGS

The foregoing aspects and other features of the present disclosure are explained in the following description, taken in connection with the accompanying drawings, wherein.

DETAILED DESCRIPTION

The term "printer" as used herein refers, for example, to reproduction devices in general, such as printers, facsimile machines, copiers, and related multi-function products. Solid ink may be called or referred to as ink, ink sticks, or sticks.

Figure 1:
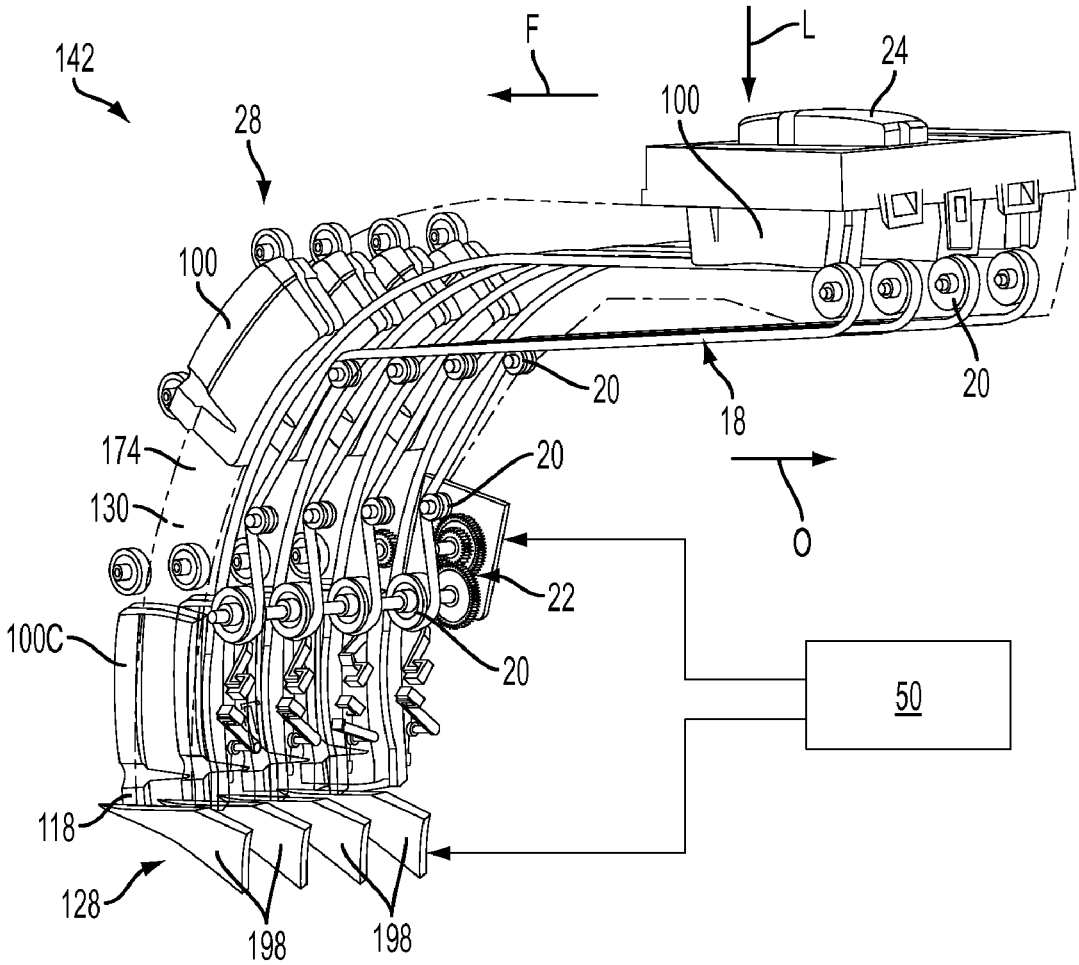
FIG. 1 is a schematic diagram of a phase change ink handling system for use in an image producing machine.

A loading system that includes a mechanized drive and a gravity fed section is shown in FIG. 1. As shown in the figure, the ink delivery system 142 includes a plurality of feed channels 130 having a curved section 28. The feed channels 130 have constraining surface 174 which may have rollers or low friction coatings to assist motion of the ink sticks. The ink delivery system 142 includes an endless belt 18 mounted around pulleys 20 at least some of which are driven by a motor and gear train 22 or the like. An ink stick 100 placed in the loading area 24 engages the belt 18 and is carried along the feed channel 130 in response to the pulleys 20 being driven. After transitioning through the curve 28, the ink stick begins a fall towards a melting assembly 128. As shown in FIG. 1, a stack of ink sticks 100 may develop in the gravity fed portion of the feed channel 130. The weight of these sticks help urge the bottommost stick 100C against the melting assembly 128 and the melt plates 198 for more efficient melting. The leading edge 118 of the ink stick 100C is in contact with or in proximity to the melting plate 198.

As shown in FIG. 1, the ink delivery system 142 may include a plurality of channels, or chutes, e.g., feed channel 130. A separate feed channel 130 is utilized for each of four different colors of solid ink, i.e., cyan, magenta, yellow, and black (CMYK). The melting assembly 128 includes a melting plate 198 for each feed channel 130. Each melt plate 198 is heated by a heater (not shown) independent of another melting plate to provide control for melting of different colors of solid ink. The four colors referenced are typical but a printer may use any practical number of unique colors, feed channels 130, and melting plates 198. The ink delivery system 142 includes loading areas 24 that provide access to the feed channels 130 of the ink delivery system 142. The feed channel receives ink sticks inserted through the solid ink loading areas 24 in an insertion direction L. In the embodiment of FIG. 1, the insertion direction L is substantially vertical, i.e., parallel to the direction of gravitational force. The feed channel 130 is configured to transport ink sticks in a feed direction F from the loading area 24 to the melting assembly 128, according to the arcuate path 28 of the feed channel 130. In the embodiment of FIG. 1, the insertion and feed directions L, F are different. For example, ink sticks 100 may be inserted in the vertical insertion direction L and then moved in a horizontally oriented feed direction F, at least initially. In an alternative embodiment, the feed channels and loading areas or insertion openings may be oriented such that the insertion and feed directions L and F are substantially parallel, perpendicular or any relative angle with or without transitions in feed direction intermediate the insertion and melt ends.

The feed channel 130 has sufficient longitudinal length so that multiple ink sticks may be sequentially positioned in the feed channel. The feed channel 130 for each ink color retains and guides ink sticks 100 so that the sticks progress along a desired feed path. The feed channel 130 may define any suitable path for delivering ink sticks from the loading areas 24 to the melting assembly 128. For example, feed channels may be linear in some sections and non-linear in other sections. Furthermore, the feed channel 130 may be disposed horizontally in some sections and vertically in other sections. In the embodiment of FIG. 1, the feed channel 130 is initially horizontally oriented and is curved downwardly toward the melting assembly 128 such that ink sticks are fed into the melting assembly in a vertical orientation. In the embodiment shown in FIG. 1 the downwardly vertical orientation of the feed channel 130 at the melting assembly 128 allows gravity to provide the primary force for transporting ink sticks toward the melting assembly 128. Alternatively, the movement of the ink sticks 100 and the force by which the ink sticks 100 make contact with the melting assembly may be influenced by the drive mechanism 142.

Power to the melting assembly 128 is cycled to control the amount of ink that is melted from the ink stick 100. A controller 50 determines when electrical power to heaters which are thermally coupled to melting plates 198 is terminated. Such heater power may be energized and/or terminated by the controller 50 or another on board processor so determining or monitoring may consist of issuing or detecting a heater power status change. In response to the termination of power, the controller 50 couples at least one heat transfer unit (not shown in FIG. 1) to the melting assembly 128 to cool melting plates 198. Utilizing a heat transfer unit, which can be an air flow device or nozzle, any type of heat sink or heat transfer element or an electrical device with thermoelectric properties or any unit similar to these devices, imposes a cooling effect on the melt plates 198. Actuating a heat transfer unit may include opening an air flow, redirecting an air flow, switching an electrical current, physically coupling it, blocking function with another element, such as moving a thermal insulator or wrap away from a heat sink, or any such enabling function. The heat transfer unit would be actuated in concert with a melt plate heater power off phase, which may be ahead of or in anticipation of power termination, in response to power termination or after power termination based on timing or state changes. The significantly limited post heater turn off melt mass with the described methods of the present teachings may advantageously reduce melt volume, as example between zero and thirty percent of the mass of an equivalent system without utilizing the current teachings to abate melting ink after the heater shutdown process. Thus the terms arrest or abate are not intended to infer instantaneous stoppage. In one type of prior art system, the melted ink mass occurring after powering down the melt plate heater is about 1.5 grams. Utilizing the current teachings on the prior art systems, the post heater turn off melt mass would be about 0.45 grams or less, the equivalent of a measurable but insignificant melt volume.

Actual improvements or reduction in post heater off melt volume is based on a number of factors. Examples of these are ink melt frontal area, mass of the melt device, temperature of the melt device, environmental temperature of the ink loader area as well as the ink sticks, heater duty cycle, geometry of the melt device, its orientation relative to gravity, etc. For example, a small vertically oriented melt plate will not have a significant volume of molten ink draining from it at the time the heater is switched off. Conversely, a large melt plate orientated at a somewhat horizontal orientation may have a significant molten ink volume that is in the process of flowing off the melt plate when the heater is turned off. Due to the energy that must be removed from such a thermal mass a combination of apparatuses and methods according to these teachings may be necessary to re-solidify the molten solid ink. Consequently, the desired improvements from the described apparatuses and methods are subject to considerable variations based on a specific implementation and associated variables.

The controller 50 includes memory storage for data and programmed instructions. The controller may be implemented with one or more general or specialized programmable processors that execute programmed instructions. The instructions and data required to perform the programmed functions may be stored in memory associated with the processors or controllers. The processors, their memories, and interface circuitry configure a controller to perform functions, such as the melt plate heater monitoring and cooling functions, which are described more fully below. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

In order to cool the melting plates to arrest melting of the leading edge 118 of the ink stick 100 within a predetermined time in response to power to the heater being terminated, several approaches may be adopted according to the current teachings. In a first group of embodiments, air stream directors are used to direct air flow towards the melting plates 198. These air stream directors are configured to generate positive or negative air pressure in a space adjacent to the melt plates to displace air surrounding the melt plates in order to cool the melt plates. In another group of embodiments, heat sinks are coupled to the melting plates 198. These heat sinks are configured to withdraw heat from the melt plates 198 in order to cool the melt plates. In another group of embodiments, thermoelectric components are coupled to the melting plates. These thermoelectric components are configured to cool the melting plates 198 when electrical current is conducted through the thermoelectric components in the appropriate direction. Each group of embodiments is discussed in detail, below.

As mentioned above, heaters are coupled to the melting plates 198 which are coupled to solid ink sticks 100. At the time power is terminated to the heater, the melting assembly 128, based on a first order circuit approximation, behaves similar to a series thermal circuit of a charged capacitor having a thermal capacitance of $C_{Th}$ and a thermal resistor having a thermal convection resistance of $R_{Th_conv}$. The thermal capacitance represents mass and other thermal characteristics of the melting assembly 128, while the thermal resistance represents heat transfer characteristics of the melting assembly 128. The thermal resistance, $R_{Th_conv}$, affects how the temperature at the melt plate decreases as a function of time. An analogy can be made to an electrical circuit with voltage representing temperature and current representing heat flow. If the melting plate was allowed to cool naturally without implementing any of the embodiments of the current teachings, the temperature at the melting plate decreases exponentially as heat is transferred from the melting plate. In the electrical circuit analogy the exponential temperature decay corresponds to a natural response of an RC circuit with an exponential voltage decay of a first order charged capacitor being switched to a resistor at time t=0 and where the capacitor discharges as a function of time. The exponential decay starts from the melt plate temperature at the moment power is terminated (in the electrical circuit, this is analogous to the voltage of the capacitor at the time the capacitor is switched on to the resistor) and decays toward a steady state temperature, i.e., ambient temperature, as time approaches infinity. Therefore, the temperature of the melting plate can be calculated for a predetermined amount of time after power has been terminated to the melting plate by using the exponential characteristics of temperature vs. time, as discussed above when the melting plate cools naturally without implementing any of the embodiments of the current teachings.

Figure 2:
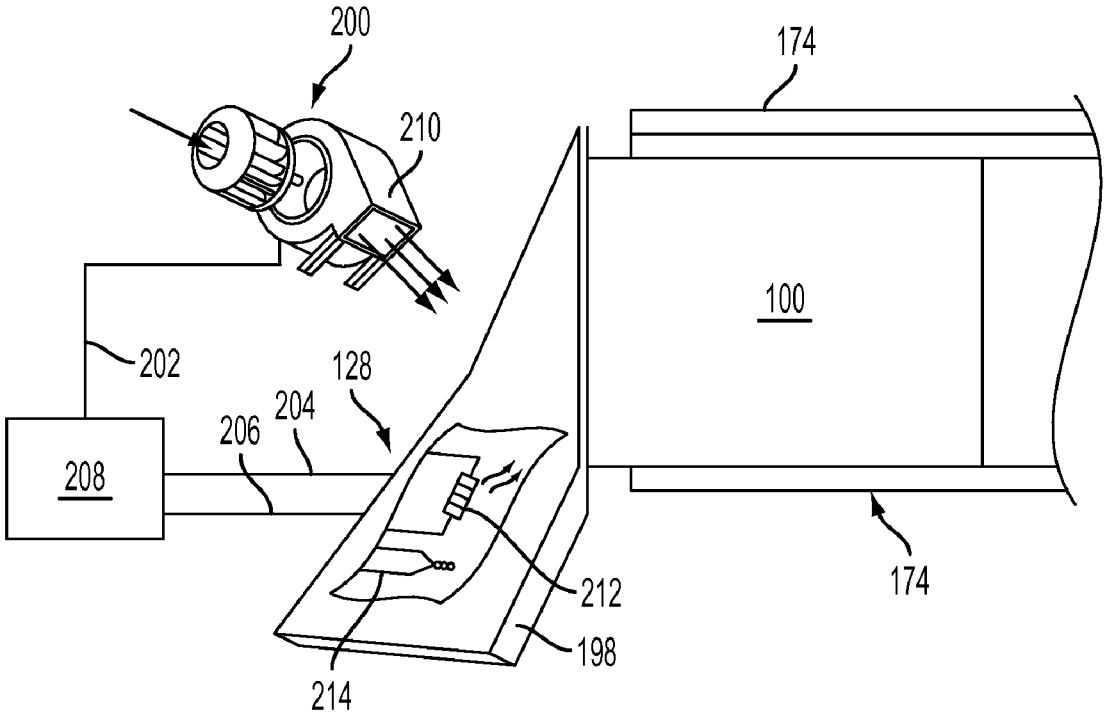
FIG. 2 is a schematic diagram of a first air stream director in a phase change ink handling assembly according to a group of embodiments.
Figure 3:
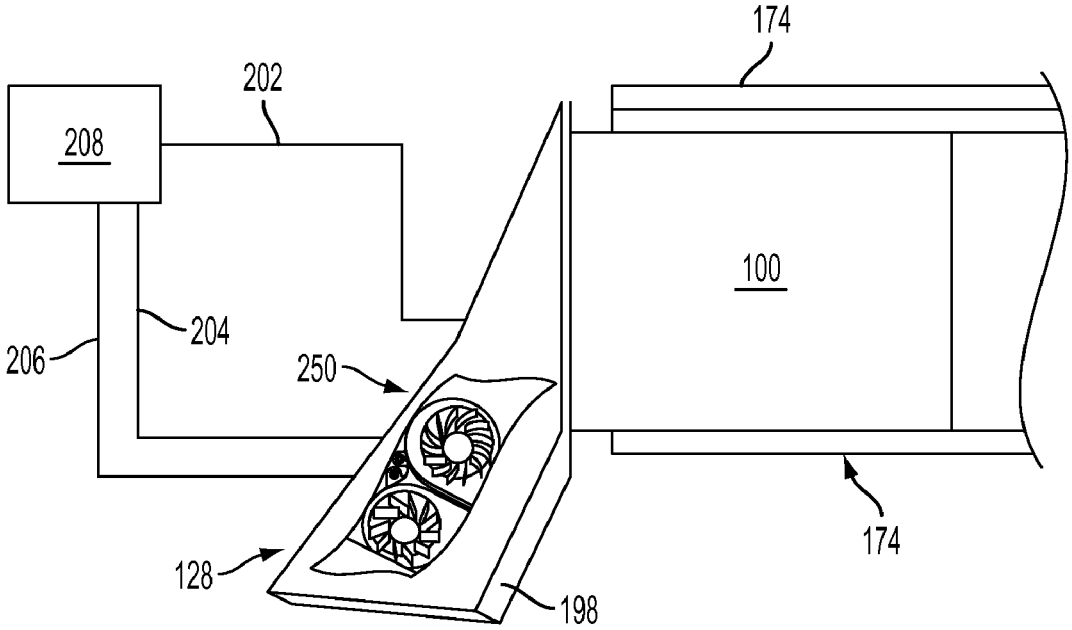
FIG. 3 is a schematic diagram of a second air stream director in a phase change ink handling assembly according to a group of embodiments.

Referring to FIGS. 2 and 3, embodiments of air stream directors are shown. In FIG. 2 an air blower 200 having air duct 210 positioned proximate to the melting plate 198 is shown. In FIG. 3, fan(s) 250 mounted on or near the melting plate 198 is shown. A controller 208 is connected to a heater 212 by line 204. The controller 208 can power the heater or simply monitor termination of power to the heater by way of its connection to the heater. In one embodiment, the controller 208 provides power to a heater 212 by line 204. Alternatively, the controller monitors termination of power to the heater 212 by line 204. In one embodiment, the controller may also monitor temperatures at different points on the melting plate 198. Thermistors 214 or other temperature sensing devices, e.g., thermocouples, can be used for monitoring temperature. The controller 208 interfaces with temperature measuring devices by line 206. The controller 208 upon detecting or controlling termination of power to the heater 212 energizes the air stream directors 200 or 250 of FIG. 2 or 3. The air stream directors 200 or 250 are powered by lines 202 from the controller. The air stream directors are configured to provide positive air pressure in the space surrounding the melting plate 198 and displace air around the melting plate to arrest melting of the solid ink stick 100. In an alternative embodiment, the air stream director applies a negative air pressure to the air space surrounding the melting plate to draw air away from the melting plate. Whether a positive or negative air pressure is applied, air surrounding the melt plate moves and hence cools the melting plate by convection. In certain embodiments, the controller may energize the air stream director a short time prior to termination of power to the heater. This approach may provide a finer control for arresting melting as the air stream director reaches an operational speed by the time the heater is powered down, and therefore, mechanical power-up delays are eliminated. Alternatively, the air stream directors of FIGS. 2 and 3 may be of a variable speed type of blower or fan. In this alternative embodiment, the controller may provide power to the air stream director continuously and only increase the speed in response to termination of power to the heater. Variation of air stream director speed may be achieved by providing varying levels of power or by selecting different speed settings on the blower or fan. In yet another alternative embodiment and in conjunction with the variable speed embodiment, the controller may provide power to the heater in a variable fashion. That is, depending on the variable speed setting of the blower or fan, the controller may apply variable levels of power to the heater.

In still yet another alternative embodiment, chilled air or other types of gas may be used to cool the melting plate. The gas can be chilled by refrigeration prior to being blown on the melting plate. Alternatively, gas can be compressed in a canister to, e.g., a liquid phase, and released onto the melting plate 198 for rapid cessation of melting of the solid ink stick. The gas can be continually compressed by a subsystem having an air compressor. Alternatively, the compressed gas can be provided in prepackage canisters that are loaded on to the system. For example, a new canister may be loaded every time an ink stick is replaced. Alternatively, surrounding air can be used by forcing it through a centrifugal cold air gun which separates the colder air molecules from the warmer air molecules and then redirecting the cold air flow to cool the melt plate.

In addition to a blower or a fan, shown in FIGS. 2 and 3, other types of air stream directors may be used. Examples of these are a nozzle, a jet, an air amplifier, and other types of air moving devices which are well known to those skilled in the art. Thermal characteristics of any of the above embodiments, can influence the thermal resistance, and in some cases the thermal capacitance, of the series circuit, discussed above. Using any of the above air stream director embodiments steepens the exponential decay of the melt plate temperature as a function of time, i.e., they accelerate heat transfer from the melting plate.

Figure 4:
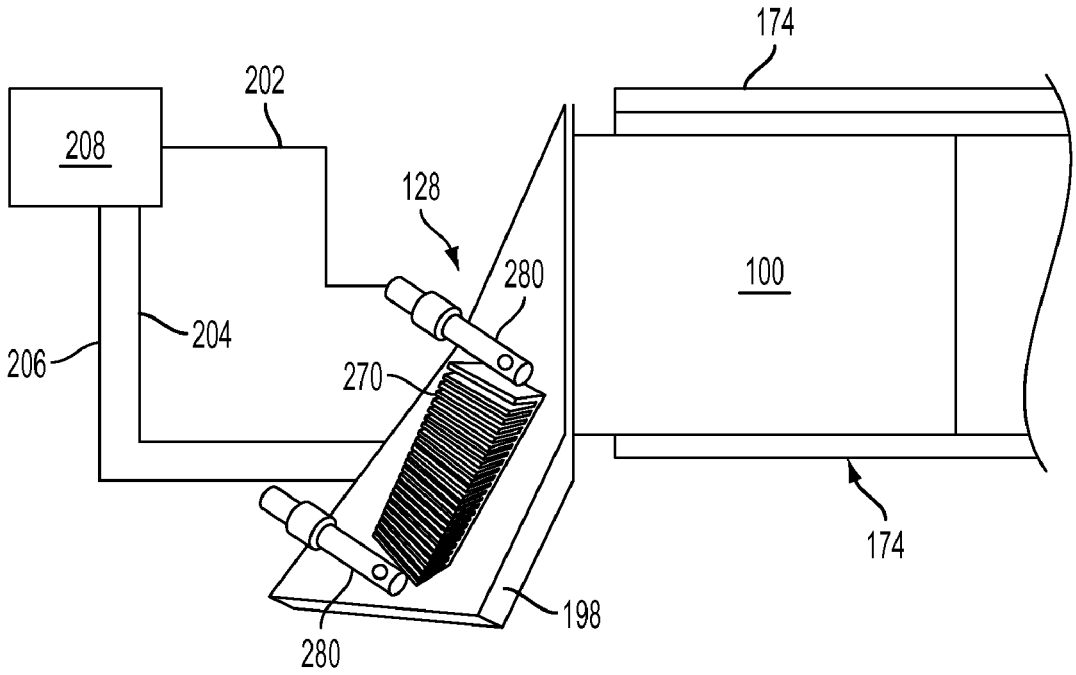
FIG. 4 is a schematic diagram of a heat sink in a phase change ink handling assembly according to a group of embodiments.

Referring to FIG. 4, an embodiment of coupling a heat sink to a melting plate is shown. Heat sinks are well known to those skilled in the art. The heat sink 270 is coupled to the melt plate 198 by actuators 280, in response to termination of power to the heater (not shown in FIG. 4). The controller 208 energizes actuators 280 by lines 202 to couple the heat sink 270 to the melting plate 198. Further, the controller 208 provides power (or monitors power) to the heater by line 204. The controller may optionally monitor temperature at different points on the melting plate by line 206. The heat sink 270 may transfer heat from the melt plate 198 to the surrounding air. Alternatively, the heat sink 270 may transfer heat from the melt plate 198 to a secondary structure, e.g., the printer housing. Transfer of heat from the melt plate 198 to the secondary structure may be more efficient, i.e., faster, than transfer of heat to the air. The heat sink 270 may be completely metallic. Alternatively, the heat sink 270 may have a layer of high thermal transfer coefficient material that interfaces with the melt plate 198 to facilitate heat transfer from the melt plate to the heat sink. This layer may be made of a flexible material to provide relief for contact tolerance between the heat sink 270 and the melt plate 198. It may also, advantageously, reduce audible clicking sounds as the heat sink 270 comes in contact with the melt plate 198.

In one embodiment a heat pipe that comes in contact with the melt plate can be used to achieve the desired cooling of the melt plate. In an alternative embodiment, the heat pipe can be connected to a secondary structure, e.g., a plate, to ensure superior heat transfer characteristics. At the moment the heat sink comes in contact with the melt plate, an initial surge of heat transfer between the melt plate and the heat sink takes place. This heat transfer surge is due to the thermal capacitance of the heat sink. After the initial surge, the melt plate cools according to the convection characteristics of the melting plate and the heat sink. In one embodiment, the heat sink is retracted from the melt plate during the melting cycles. The retraction distance should be sufficient to mitigate heat transfer from the melt plate to the extent of attaining the desired degree of heating efficiency. The design of the heat sink also plays a significant role in the efficiency of heat transfer from the melt plate 198. For example, the number of convective fins on the heat sink, the proximity of fins to each other, and the size of the fins are among design factors that influence the efficiency of heat transfer from the melt plate.

In one embodiment the heat sink is a liquid filled structure that when engaged with the melting plate surrounds the melting plate. In this embodiment, when termination of power to the melting assembly is detected, the heat sink engages the melting plate and the liquid inside the heat sink circulates to effectively withdraw heat from the melting plate. During the melting cycle, however, the heat sink according to this embodiment is retracted to avoid interference with the heating operation of the melting plate.

Coupling a heat sink to a melt plate, based on a first order circuit approximation, can be represented by an equivalent series circuit connected to $R_{Th_conv}$. The series circuit includes a thermal conduction resistor $R_{Th_cond}$ (representing the thermal conductive resistance between the melt plate and the heat sink), an uncharged or slightly charged thermal capacitor $C_{Th2}$ (representing the uncharged or partially charged thermal capacitance of the heat sink), and a thermal convection resistor $R_{Th_heat_sink}$ (representing the thermal convection/conduction resistance of the heat sink to ambient air/secondary structure). Using any of the above heat sink embodiments steepens the exponential decay of the melt plate temperature as a function of time, i.e. accelerates heat transfer from the melting plate.

The timing of coupling the heat sink to the melting plate can vary according to different embodiments, similar to the timing of coupling of air stream directors to the melting plate. That is, the heat sink 270 can be coupled to the melting plate 198 slightly before termination of power to the melting assembly. This embodiment may provide finer cooling control. Also, power in a variable form can be provided to the melting assembly in order to control the transfer of heat from the melt plate more precisely.

Figure 5:
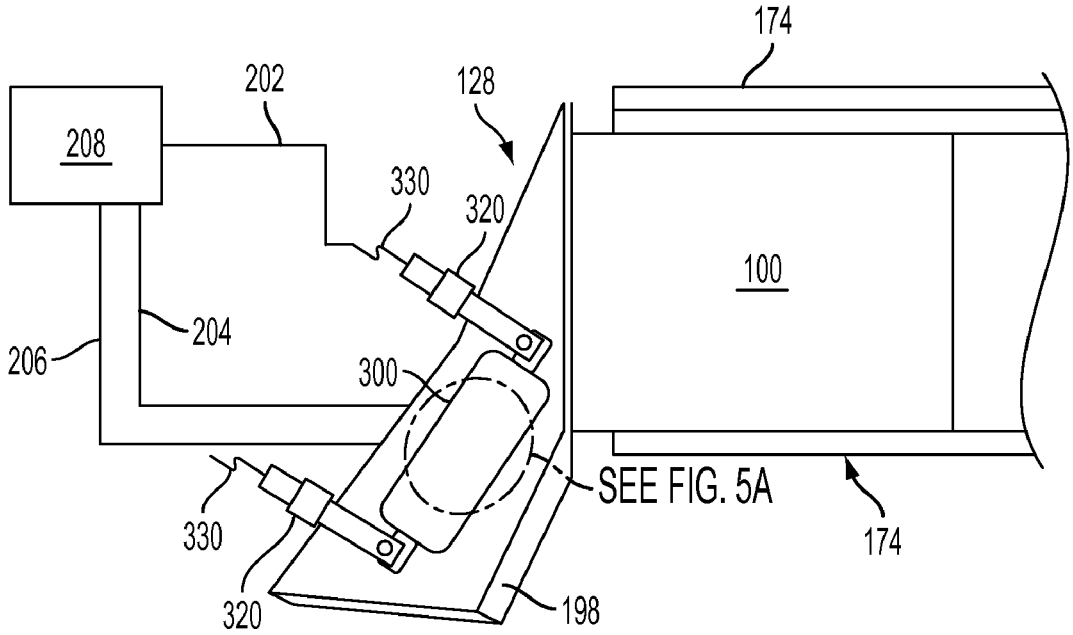
FIG. 5 is a schematic diagram of a thermoelectric component in a phase change ink handling assembly according to a group of embodiments.

Referring to FIG. 5, an embodiment of coupling a thermoelectric component to a melting plate is shown. A thermoelectric component is configured to withdraw heat from one surface when an electrical current is passed through the thermoelectric component in a first direction. Conversely, the thermoelectric component can generate heat at the same surface if the electrical current is passed through in a second direction, opposite to the first direction. In one embodiment, the thermoelectric component can be coupled to the melt plate similar to the way the heat sink is coupled to melt plate. This is the embodiment shown in FIG. 5. In this embodiment, the thermoelectric component 300 is coupled to the melt plate 198 by way of actuators 320. The controller 208 energizes actuators 320 by line 202. Further, the controller 208 provides power (or monitors power) to the heater (not shown) by line 204. The controller may optionally monitor temperature at different points on the melting plate by line 206. The thermoelectric component 300 comes in contact with the melt plate 320 when the controller detects or terminates power to the melting assembly 128. Electrical current is passed through the thermoelectric component 300 through electrical leads 330. In one embodiment, the electrical leads 330 can be attached to the actuator 320, and the actuator 320 and thermoelectric component provided as a package. In another embodiment, the electrical leads can be tethered to the thermoelectric component 300 without being attached to the actuators 320. In one embodiment, the thermoelectric component 300 is permanently affixed to the melt plates 198 and no actuators are used to move the thermoelectric component in contact with the melting plate. In this embodiment the electrical leads 330 are tethered to the thermoelectric component 300.

In accordance with an alternative embodiment, the thermoelectric component can be attached to the melting plate 198 or be all or a part of the heater. Application of electrical current in one direction causes the thermoelectric component to heat the melting plate, in concert with the heater. Application of electrical current in the opposite direction causes the thermoelectric component to absorb heat from the melting plate.

Applying an electrical current to one of the electrical leads causes the thermoelectric component to transfer heat away from the melting plate. Unlike the previous heat transfer units, i.e. air stream directors and heat sinks, a thermoelectric component is capable of lowering the temperature of the melting plate to below the ambient temperature. As such, the thermoelectric component 300 connectivity to the melting plate 198 can be schematically represented based on a first order series circuit coupled to $R_{Th}$. This secondary series circuit includes a thermal conduction resistor $R_{Th_cond}$ (representing the thermal conduction resistance between the melting plate 198 and the thermoelectric component 300), and a current source $I_s$ (representing the active heat transfer mechanism of the thermoelectric component). Using any of the above thermoelectric component embodiments steepens the exponential decay of the melting plate temperature as a function of time, i.e. accelerates heat transfer from the melting plate.

The timing of coupling the thermoelectric component to the melting plate can vary according to different embodiments, similar to the timing of coupling of air stream directors to the melting plate. That is, the thermoelectric component 300 can be coupled to the melting plate 198 slightly before termination of power to the melting assembly. This embodiment may provide finer cooling control. Also, power in a variable form can be provided to the melting assembly in order to finer control the heat transfer from the melting plate.

Figure 5A:
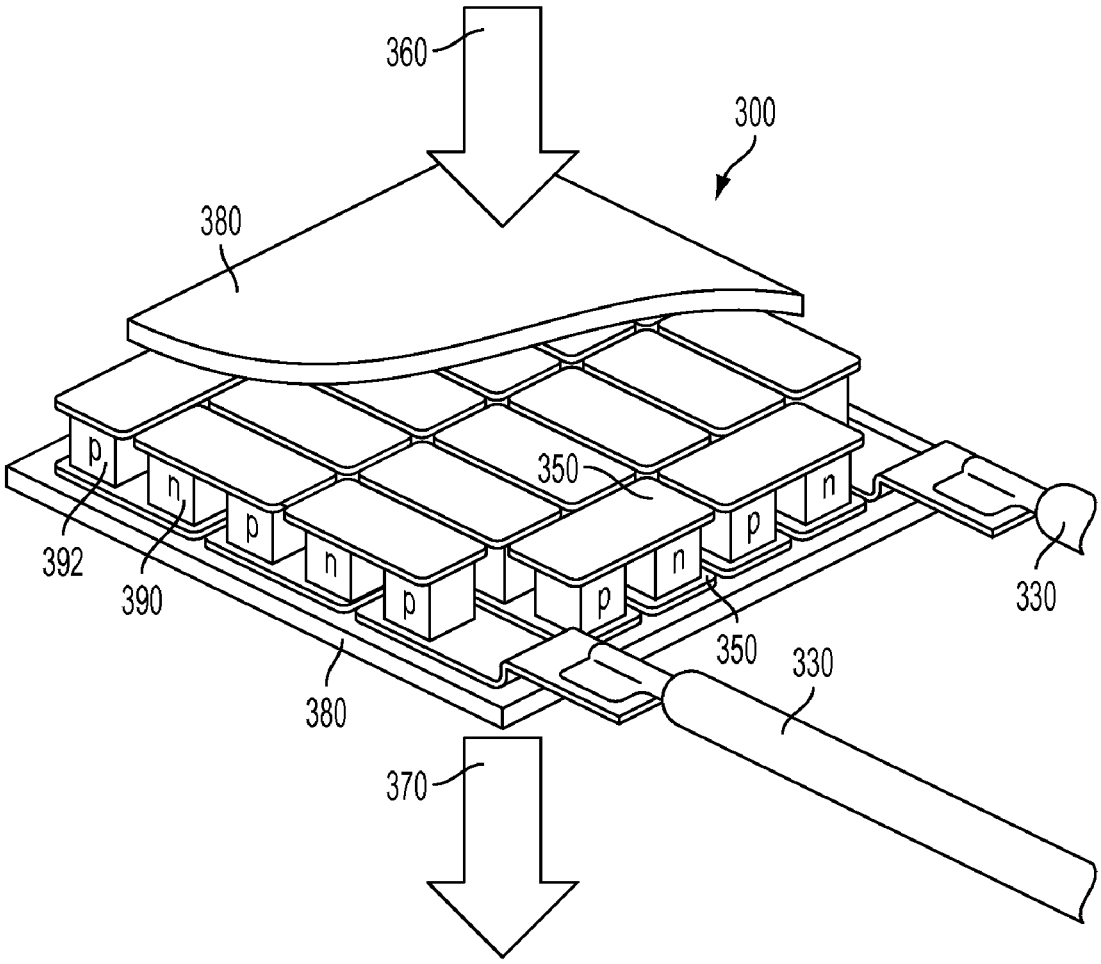
FIG. 5A is a close up diagrammatic perspective view of the thermoelectric component of FIG. 5 implemented in a phase change ink handling assembly according to a group of embodiments.
Figure 5B:
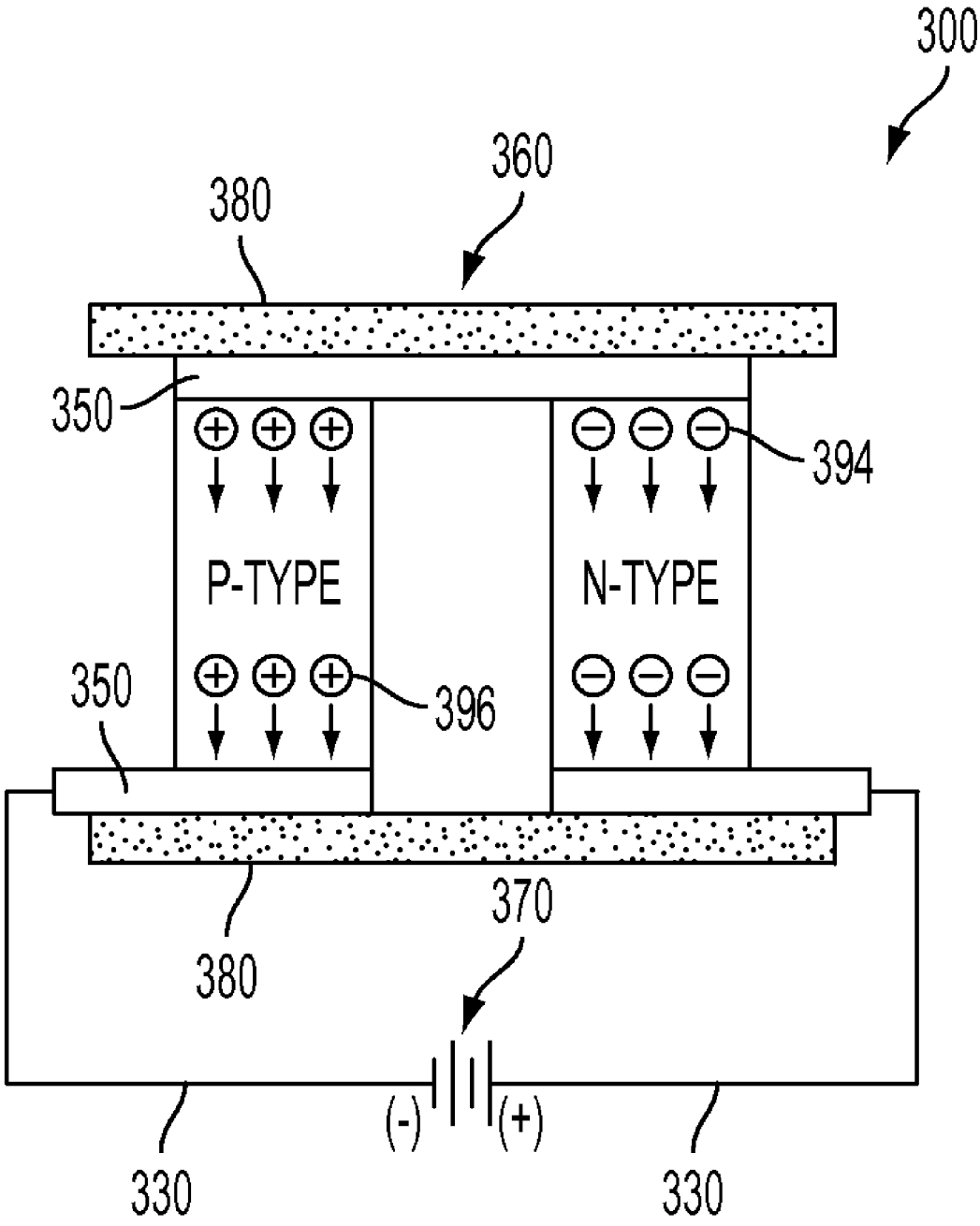
FIG. 5B is a schematic view of the thermoelectric component of FIG. 5 implemented in a phase change ink handling assembly according to a group of embodiments.

Referring to FIG. 5A, a diagrammatic perspective close up view of the thermoelectric component 300 is provided. Referring to FIG. 5B a circuit schematic representation of FIG. 5A is provided. Leads 330 provide electrical current to the thermoelectric component 300. Positively and negatively doped semiconductors, 392 and 390, selectively connected between copper layers 350 are disposed on substrate 380, e.g., a ceramic substrate. Choice of composition can affect the thermal efficiency of the thermoelectric component. In one embodiment, the thermoelectric component is made from bismuth telluride. Application of electrical current through leads 330, causes heat to be absorbed, i.e., cooled, as shown with direction 360 through the top surface. Simultaneously, heat is rejected, through the bottom surface, as shown by arrow 370. Conversely, application of electrical current in an opposite direction causes heat to be rejected through the top surface, in a direction opposite to 360. In FIG. 5B, migration of holes and electrons, 396 and 394, from one surface to another is shown in accordance with application of current in a direction that causes the thermoelectric component to cool the top surface.

In operation, the controller of a solid ink printer is configured with programmed instructions to monitor the heaters for the melting plates in the printer and to cool the melting plates in response to the detection of power to a heater being terminated. The instructions also enable the controller to couple heat transfer units to the melting plates in order to withdraw heat from the melting plate to arrest melting of solid ink sticks. In one group of embodiments, the controller energizes air stream directors to move air surrounding the melting plates. In another group of embodiments, the controller activates actuators in order to couple heat sinks to the melting plate. In another group of embodiment, the controller couples a thermoelectric component to the melting plate and conducts electrical current through the thermoelectric component in a direction so that heat from the melting plate is absorbed by the thermoelectric component.

It will be appreciated that various of the above-disclosed and other features, and functions, or alternatives thereof, may be desirably combined into many other different systems or applications. A few of the alternative implementations may comprise various combinations of the methods and techniques described. Various presently unforeseen or unanticipated alternatives, modifications, variations, or improvements therein may be subsequently made by those skilled in the art, which are also intended to be encompassed by the following claims.

The invention claimed is:

1. A method for controlling application of heat with a melt plate to an ink stick in a solid ink imaging device comprising:

detecting termination of electrical power provided to a heater that heats a melt plate positioned at one end of a feed channel in a solid ink printer;

selectively activating an actuator to move a heat transfer unit from a position out of contact with the melt plate to a position contacting the melt plate and;

activating the heat transfer unit to arrest melting of a leading edge of an ink stick engaging the melt plate within a predetermined time relative to the termination of electrical power to the heater.

2. The method of claim 1, the selective activation of the actuator further comprising:

moving a heat sink into contact with the melt plate.

3. The method of claim 2, wherein the heat sink is one of a block of heat transfer material, a heat pipe, and a plurality of convective fins.

4. The method of claim 1, the selective activation of the actuator further comprising:

moving a thermoelectric component into contact with the melt plate, and the activation of the thermoelectric component includes passing an electrical current through the thermoelectric component in a direction that operates the thermoelectric component as a heat sink with reference to the melt plate.

5. A system for controlling application of heat with a melt plate to an ink stick in a solid ink imaging device comprising:

a melt plate;

a heater configured to heat the melt plate to a temperature sufficient to melt solid ink;

a heat transfer unit;

an actuator coupled to the heat transfer unit; and a controller operatively connected to the actuator, the controller being configured to generate a control signal that operates the actuator to move the heat transfer unit from a position out of engagement with the melt plate to a position in contact with the melt plate and to actuate the heat transfer unit to cool the melt plate and arrest the melting of the solid ink within a predetermined time in response to the controller detecting termination of electrical power to the heater.

6. The system of claim 5, the heat transfer unit comprising:

a heat sink.

7. The system of claim 5, the heat transfer unit comprising:

a thermoelectric component coupled to the controller and the controller is further configured to couple an electrical current to the thermoelectric component to enable the thermoelectric component to absorb heat in response to controller detecting the termination of electrical power to the heater.

8. A system for controlling application of heat with a melt plate to an ink stick in a solid ink imaging device comprising:

a melt plate positioned at an end of a feed channel to melt a portion of a solid ink stick in the feed channel that impinges on the melt plate; and a thermoelectric component operatively connected to a surface of the melt plate that does not engage solid ink in the feed channel, the thermoelectric component being operated by a controller to heat the melt plate to a temperature sufficient to melt solid ink impinging on the melt plate in response to an electrical current passing through the thermoelectric component in a forward direction and to cool the melt plate to arrest the melting of the solid ink impinging on the melt plate within a predetermined time in response to the electrical current passing through the thermoelectric component in a reverse direction.

9. The system of claim 8, wherein the thermoelectric component is made from bismuth telluride.

* * * * *